United States Patent [19]

Matsumoto et al.

[11] Patent Number: 4,666,465

[45] Date of Patent: May 19, 1987

[54] PROCESS FOR MANUFACTURING FINE BLASTING MEDIA FOR USE IN WET BLASTING

[75] Inventors: Katsuaki Matsumoto, Numazu; Takao Taguchi, Tokyo, both of Japan

[73] Assignee: Fuji Seiki Machine Works, Ltd., Shizuoka, Japan

[21] Appl. No.: 782,252

[22] Filed: Sep. 30, 1985

Related U.S. Application Data

[62] Division of Ser. No. 534,528, Sep. 22, 1983, Pat. No. 4,575,396.

[30] Foreign Application Priority Data

Oct. 17, 1982 [JP] Japan ..... 57-179797

[51] Int. Cl.[4] ..... B24D 3/00

[52] U.S. Cl. ..... 51/293; 51/295; 51/298; 51/308; 134/7

[58] Field of Search ..... 51/293, 298, 295, 308; 134/7

[56] References Cited

U.S. PATENT DOCUMENTS

| | | | |
|---|---|---|---|
| 3,225,495 | 12/1965 | de Vries | 51/298 |
| 3,313,067 | 4/1967 | Smith et al. | 51/298 |
| 3,765,923 | 10/1973 | Bender-Christensen | 51/308 |
| 4,125,969 | 11/1978 | Easton | 51/308 |
| 4,333,743 | 6/1982 | Nojima | 51/298 |
| 4,548,617 | 10/1985 | Miyataui et al. | 51/298 |

*Primary Examiner*—Paul Lieberman
*Assistant Examiner*—Willie J. Thompson
*Attorney, Agent, or Firm*—Flynn, Thiel, Boutell & Tanis

[57] ABSTRACT

A wet blasting media involving fine particles having a mean diameter less than 0.5 mm, and a specific gravity of at least 1.5. The particles are formed by glass beads having an irregular plastics resin mass therearound, such as a polyacetyl or polycarbonate resin. The resin has a specific gravity of 1.3 or greater. The particles readily uniformly mix with water to permit uniform blasting of articles, and at the same time the glass beads provide the particles with the desired density but do not damage the surface of the articles being blasted.

A method of making the blasting particles wherein the glass beads are coated with a coupling agent and thereafter are mixed with the selected resin. The mixture is extruded into a selected shape, such as a rod, which is then pelletized. The pellets are frozen rapidly at a very low temperature, and are immediately crushed or pulverized when in this fragile frozen state so as to form the fine but irregular blasting particles.

5 Claims, 3 Drawing Figures

PROCESS FOR MANUFACTURING FINE BLASTING MEDIA FOR USE IN WET BLASTING

This is a division of application Ser. No. 534,528, filed Sept. 22, 1983 now U.S. Pat. No. 4,575,396.

FIELD OF THE INVENTION

This invention relates to an improved blasting media, particularly for wet blasting of resin articles to remove burr and flash without damaging or seriously abrading the article surface, and to the method of manufacturing the blasting media.

BACKGROUND OF THE INVENTION

Particulate blasting is widely used for deburring and cleaning cast and machined metal parts, for cleaning surfaces of these objects, and for surface preparation of metals. In this blasting process, ferrous particles such as steel grit or steel shot, nonferrous metal particles, artificial abrasive particles such as alumina, and natural abrasive particles such as silica sand, are generally used as the blasting media. Such blasting media, however, can be successfully utilized only when working with hard or heavy metal objects.

When parts are made of soft metals such as copper or zinc, or parts are formed of synthetic resins, these known hard blasting particles can not be utilized for blasting of the parts since such hard blasting media excessively deform the objects and/or abrade the surface thereof to an undesired degree. Accordingly, for these softer parts, the blasting normally involves the use of so-called "soft grits". This "soft grit" is mainly natural grit made from plant seeds or walnut shells.

In comparing the soft and hard grits or particles used in blasting, it is generally recognized that the blasting media required for use on hard or heavy metal parts must generally have substantial mechanical properties such as mechanical strength, surface hardness and impact resistance, and for this reason the hard particles of the type mentioned above are commonly used. On the other hand, when the object to be blasted is formed from soft metals or synthetic resins, while the soft blasting media must have many of the same properties as the hard particles, nevertheless it is also a requisite that the soft blasting media not abrade the surface of the article too harshly, or not change the surface condition of the article too severely.

For example, when the object comprises an IC chip (integrated circuit chip), a metal lead frame is packaged within a housing of synthetic resin which is molded therearound, which resin is positioned such that the metal conductive leads project outwardly from the resin housing at selected locations. Due to this molding of the resin housing about the lead frame, resin burr or flash is conventionally formed at the interface between the resin housing and the metal lead frame. Resin smears also normally occur on the metal leads, or between the metal leads, where they project outwardly from the resin housing. In the past, it has been conventional practice to remove the resin burrs, flash and smear by blasting the IC chips with alumina particles of No. 120 to No. 200 mesh size. While this known technique has been able to successfully remove the resin burr or flash or smear, nevertheless this at the same time undesirably abrades the surface of the resin package, thereby significantly affecting the appearance and hence the commercial value of the resultant product. Further, in situations where the resultant product must possess a precise surface condition or finish, this abrading of the surface is wholly undesirable and can make the part wholly unacceptable for its intended use.

To overcome the above problem, parts or objects of this type have hence been blasted using soft grit so as to avoid excessive surface abrasion. However, the natural soft grits such as corn cob, walnut shell and cherry seed, when mixed with water to form a slurry and then sent to a blasting gun, have proven generally unsatisfactory in performance since the particles swell and are not capable of withstanding this type of usage.

Attempts have been made to utilize blasting media formed as synthetic resin particles. However, in order for the blasting media to perform satisfactorily, the media must have sufficient density to create a substantial impact against the object, but at the same time the media must have properties such that it does not hurt or abrade the surface of the article. These two seemingly contradictory requirements hence appear to demand the use of media which has substantial weight but which still has a soft surface. While synthetic resin particles are presently being used, as noted above, nevertheless these synthetic resin particles have also been unable to perform satisfactorily, and hence unable to solve the apparent contradictory requirements for media usable with resin-metal parts, such as IC chips. As to the synthetic resin particles presently being used as blasting media, such particles normally are rather large in diameter, such as a mean diameter of between 0.5 to 2.0 mm. When such particles are used for removing resin flash and burrs, such as from an IC chip, the particles can only partially remove the burr or flash and hence are incapable of finely finishing the complete part.

Further, when these known synthetic resin particles are used in a wet blasting process, it has been observed that the particles do not uniformly mix within the stream of blasting water. For example, the conventional plastics used for these synthetic resin particles are styrene, and polyamide, which plastics have a specific gravity in the range of about 1.0 to 1.1. Other known resins, specifically engineering plastics such as polycarbonate (specific density 1.3) and polyacetyl (specific gravity 1.4) are somewhat heavier but, by themselves, also do not perform a satisfactory finishing of the articles as regards complete removal of the burr, flash and smear. When these conventional resin particles are utilized in conjunction with a stream of water for wet blasting, which is believed to be a preferred technique for the blasting of articles such as IC chips, it has been observed that the plastic particles do not readily sink in water and hence tend to float within the stream, so that a uniform mixture of the particles within the water stream is not achieved, and hence uniform blasting of the article or object can not be effected.

With respect to blasting particles formed of polycarbonate, attention is directed to U.S. Pat. No. 3,313,067 which relates to a process for deflashing articles utilizing polycarbonate resin particles for blasting the formed parts or articles, which particles have a mean diameter of from about 25 mils to about 200 mils (about $\frac{5}{8}$ mm to about 8 mm). The blasting process of this patent possesses the disadvantages discussed above.

Thus, it is an object of this invention to provide an improved fine blasting media specifically for wet blasting of parts and articles having resin or other relatively soft portions and surfaces so as to permit efficient and effective removal of burrs, flash and the like without damaging, scarring or seriously abrading the surface of the part. This invention also relates to the method of using and manufacturing this improved blasting media.

More specifically, the improved blasting media involves fine particles having a mean diameter less than 0.5 mm, and a mean diameter preferably between 0.2 mm and 0.3 mm, with the specific gravity of the particles being greater than 1.5. The particles are irregular, polygonal shaped, hard particles of a plastics resin having a specific gravity of about 1.3 or greater, such as polyacetyl or polycarbonate, with one or more glass beads being embedded within and surrounded by the resin to provide the particles with the desired density. The resulting particles, due to their size and density, readily uniformly mix with water to permit uniform blasting of articles, and at the same time the plastic resin acts as a coating for preventing the glass beads, which provide the particles with the desired density, from damaging the surface of the part being blasted. The plastics resin itself possesses substantial strength to perform the desired impacting and removing of the burr and flash from the object without scarring or abrading the surfaces of the part. This improved blasting media includes about 85% to about 70% by weight of plastics resin, and about 15% to about 30% by weight of glass beads.

While the coating of glass beads with a resin for forming blasting particles is already known, as disclosed in U.S. Pat. No. 3,225,495, nevertheless the particles in this latter patent utilize an epoxy resin for forming a thin coating around each glass bead, which resin is normally filled with polishing particles. The thus-formed particles are basically spherical, and have a single glass ball forming the core, and hence the major mass of the particle. In fact, only about 2 to 12 parts by weight of resin are used for each 100 parts by weight of glass beads. These particles are heavy and hence severely impact the surface of the articles and normally create a compressive stress layer at the surface. The blasting particles of this latter patent hence are suitable for polishing, but are not suitable for effective removal of burrs and flash without causing substantial surface damage. Further, the coating on the glass beads is primarily for the purpose of preventing fracturing of the glass beads upon impacting thereof against a surface.

In the improved method of making the blasting particles according to the present invention, the glass beads are coated with a silane coupling agent and thereafter are mixed with the selected plastic resin. The mixture is then extruded into selected shapes, such as rods, which are then pelletized. The pellets are then frozen rapidly at a very low temperature, and are immediately crushed or pulverized when in this fragile frozen state so as to form the fine but irregular blasting particles.

Other objects and purposes of the invention will be apparent after reading the following specification.

DETAILED DESCRIPTION

Figure 3:
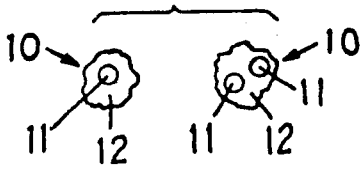
FIG. 3 is a cross-sectional view of hypothetical particles which might be formed according to the present invention.

Referring to FIG. 3, there is diagrammatically illustrated the cross-sectional view of typical blasting particles 10 according to the present invention. Each particle is composed of an irregularly shaped mass or body 12 having one or more conventional spherical glass beads 11 embedded therein. The mass 12 comprises a resin, commonly known as an engineering plastics, which surrounds and is fixedly attached to the outer surface of the glass bead. The blasting particles 10 according to the present invention normally have a mean diameter D which is less than 0.5 mm, and this mean diameter is preferably in the range of between about 0.2 mm and about 0.3 mm. The specific gravity of this blasting media is greater than 1.5.

The glass beads used to form the particles normally have a mean diameter less than 0.1 mm, and preferably have a mean diameter between about 0.05 mm and about 0.0005 mm.

As to the engineering plastics defining the mass 12, this preferably comprises any suitable resin having a specific density of about 1.3 or greater, and also having substantial strength and hardness, particularly a Rockwell hardness of M-80 or more. The engineering plastics should, however, not have any affinity with water. Preferred resins for forming the mass 12 are polycarbonate, polyacetyl and polyester. These plastics are normally available in both thermo-plastic and thermosetting resins.

To summarize the manufacture of the blasting media of this invention, the glass beads are initially coated with a suitable coupling agent, such as a conventional silane coupling agent. The glass beads, as is known, have a specific gravity of about 2.5. After the glass beads have been coated with the coupling agent, then they are mixed with the selected engineering plastics, such as polycarbonate or polyacetyl, whereupon the plastics resin adheres to the glass beads and becomes firm and rigid. The quantity of glass beads and plastics resin is selected such that the specific gravity of the resulting mixture is in the range of about 1.5 to 2.0, and preferably is in the range of about 1.5 to about 1.7. The mixture is extruded by a conventional extruder into desired shapes, preferably elongated rods, which rods are cut into pellets in a conventional manner. The pellets are then rapidly frozen to a temperature in the range of from about −50° C. to about −195° C. This freezing of the pellets occurs by exposing the pellets to a freezing media such as liquid nitrogen or liquid oxygen. The pellets are then crushed when in this frozen or brittle state so as to form the irregularly shaped polygonal blasting particles 10 of the present invention, which individual particles essentially comprise one or more glass beads having an irregular resin mass therearound as diagrammatically illustrated by FIG. 3. The resulting particles have the physical properties specified above.

Considering now the application of the coupling agent to the glass beads, the beads are generally initially confined in a container and are sprayed with the coupling agent. A silane coupling agent is desirable for this purpose. To permit application of the coupling agent to the glass beads, the silane coupling agent is mixed with ethyl alcohol so as to form a solution which is about 12% to about 15% by weight of silane, and about 88% to about 85% by weight of alcohol. This solution is then sprayed on the glass beads, whereupon the alcohol evaporates so that only the coupling agent remains on the surface of the glass bead. While the use of the silane-alcohol solution is preferred, nevertheless some types of silane coupling agents are soluble in water, and could be utilized. Some of the typical silane coupling agents which can be used are γ-aminopropyl-triethoxy-silane, γ-glycidoxypropyl-trimethoxy-silane and γ-methacryloxypropyl-trimethoxy-silane. Titanate coupling agents could also be used, although the silane series of coupling agents is more suitable for use when mixing plastics with glass beads.

After the glass beads have been coated with the coupling agent as explained above, the thus-coated beads are mixed with the desired quantity of pellets of the selected plastics material of the thermo-plastic type, and then are deposited in the hopper of a conventional plastic extruder. The extrusion process is a conventional one which results in the extrusion of an elongated rod which typically will be of a diameter in the range of 1.5 mm to about 3.2 mm, the temperature at extrusion being about 200° C., with the extrusion speed being in the range of about 1 meter per minute to about 5 meters per minute, and the extrusion pressure being in the range of about 750 kg/cm$^2$ to about 200 kg/cm$^2$. As the material is extruded from the die of the extruder, the extruded rod is immediately cut into pellets, which pellets have lengths which are approximately equal to their diameter. Thereafter, the pellets are rapidly frozen to a temperature of at least −50° C., and preferably are frozen to a temperature in the neighborhood of about −195° C. to about −200° C. When in this frozen state, the pellets are pulverized by means of a conventional crusher so as to result in formation of the small blasting particles 10 according to the present invention. The thus-formed particles 10 normally each have at least one glass bead 11 embedded within the surrounding plastics mass 12, and in some particles there may be two or three such glass beads 11 embedded within the single surrounding plastic mass 12.

The plastic pellets and glass beads are mixed together in proportions such that the resulting mixture is about 70% to about 85% by weight of plastics material, and about 30% to about 15% by weight of glass beads. These two components make up substantially 100% by weight of the resulting composition inasmuch as no other materials are included, and the remains of the coupling agent are trivial and do not have any significant effect as to the content of the resulting composition.

The resulting particles 10 hence have a polygonal shape which is irregular, thereby effectively providing each particle with fractured surfaces and edges due to the crushing of the pellets when in the frozen brittle state. The fractured edges and surfaces on the irregularly shaped polygonal particles 10 hence effectively act as cutting or rubbing edges so as to permit efficient shearing or cutting off of soft materials such as flash or burrs to permit finishing of the article.

With the particles of this invention, the particles will readily sink in water and hence will readily mix with water so as to provide for uniform wet blasting of parts and objects.

The improved blasting media of this invention is particularly suitable for removing burr or smear which grows at the interface between the resin package and the lead frame, or between the lead sections, as associated with an IC chip. This improved blasting media permits wet blasting so as to permit minute deburring operations and surface cleaning to be performed without damaging the surface.

Figure 1:
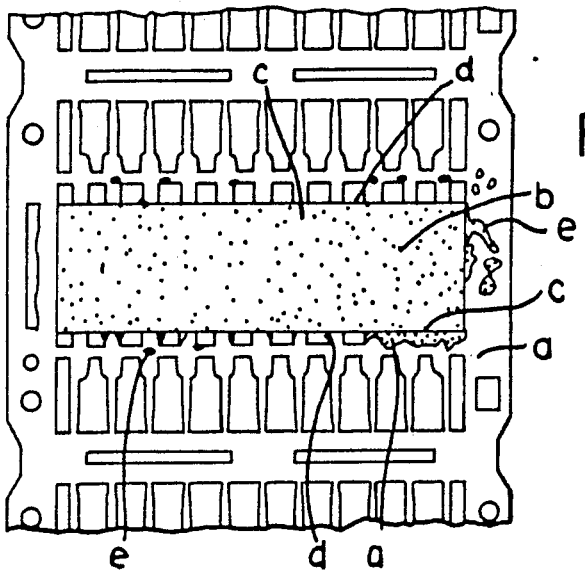
FIG. 1 is a fragmentary top view of a lead frame after several chips or resin packages have been formed thereon.
Figure 2:
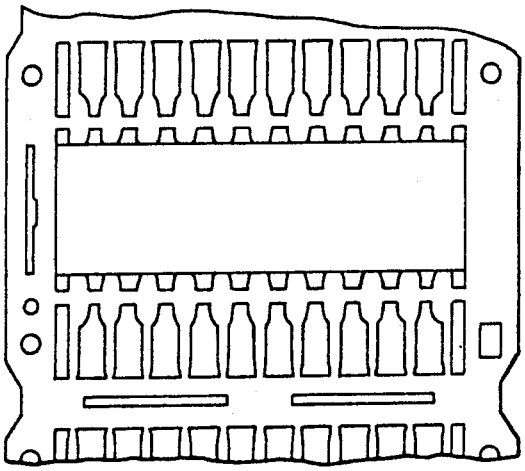
FIG. 2 is a fragmentary top view of the lead frame shown in FIG. 1 after blasting thereof so as to deburr and clean same.

As shown in FIG. 1, there is illustrated a lead frame a having a resin package b molded thereon so as to form an IC chip, which resin package has a plurality of conventional conductive leads projecting therefrom. During the molding of the package b, resin burrs, flash and smear form particularly at the interface between the resin package and the lead frame, and between the leads themselves, as diagrammatically illustrated at d and e. By subjecting this IC chip to wet blasting using the blasting media of this invention, the burr and flash, such as d and e, can be efficiently and effectively removed, while at the same time the exposed surfaces c of the package b are not abraded to any significant degree such that a surface satin mat appearance is not created, but rather the surfaces have merely a desired luster. This hence results in a clean and deburred part as diagrammatically illustrated by FIG. 2.

The wet blasting procedure utilizes a mixture of the inventive blasting media and water, together with compressed air, to form a jet stream which is directed against the object to be cleaned. Due to the size and specific gravity of the blasting particles of this invention, the particles have a good sinking speed and hence can be mixed evenly and uniformly with the water, whereby a substantially even and uniform ratio of blasting media and water is obtained. The wet blasting media of this invention is hence highly suitable for fine finishing.

Although a particular preferred embodiment of the invention has been disclosed in detail for illustrative purposes, it will be recognized that variations or modifications of the disclosed apparatus, including the rearrangement of parts, lie within the scope of the present invention.

The embodiment of the invention in which an exclusive property or privilege is claimed are defined as follows:

1. A process for manufacturing fine blasting media for use in wet blasting, comprising the steps of coating glass beads with a coupling agent, mixing the glass beads with a synthetic resin to form a uniform mixture, extruding the mixture into a rodlike object, cutting said rodlike object into pellets, freezing said pellets, and crushing the frozen pellets to form small particles which comprise an irregularly shaped resin mass having at least one glass bead embedded therein.

2. A process according to claim 1, wherein the resin has a specific gravity of at least about 1.3, wherein the quantities of resin and glass beads are selected so that the resulting mixture has a specific gravity of between about 1.5 and about 2.0, and wherein the resulting particles have a mean diameter of less than about 0.5 mm.

3. A process according to claim 1, wherein the pellets are rapidly frozen to a temperature in the range of about −50° C. or below.

4. A process according to claim 1, wherein the resin comprises polycarbonate or polyacetyl.

5. A process according to claim 1, wherein the pellets are rapidly frozen to a temperature in the neighborhood of about −200° C.

* * * * *